United States Patent [19]

Berry

[11] Patent Number: 4,753,301

[45] Date of Patent: Jun. 28, 1988

[54] WELL PERFORATING GUN ASSEMBLY

[75] Inventor: William J. Berry, Pampa, Tex.

[73] Assignee: Titan Specialties, Inc., Pampa, Tex.

[21] Appl. No.: 916,161

[22] Filed: Oct. 7, 1986

[51] Int. Cl.[4] ..... E21B 43/117

[52] U.S. Cl. ..... 175/4.6; 166/55; 166/55.1

[58] Field of Search ..... 175/4.6; 166/55, 55.1, 166/55.2, 297; 102/320, 321

[56] References Cited

U.S. PATENT DOCUMENTS

| | | | |
|---|---|---|---|
| 2,494,256 | 1/1950 | Muskat et al. . | |
| 2,742,857 | 4/1956 | Turechek . | |
| 2,756,677 | 7/1956 | McCullough . | |
| 2,873,676 | 2/1959 | Caldwell . | |
| 2,916,991 | 12/1959 | Gilbert . | |
| 2,947,250 | 8/1960 | Mohaupt . | |
| 3,078,797 | 2/1963 | Blair . | |
| 3,128,702 | 4/1964 | Christopher . | |
| 3,441,093 | 4/1969 | Boop | 175/4.55 |
| 3,565,188 | 2/1971 | Hakala . | |
| 3,739,723 | 6/1973 | Hakala . | |
| 3,762,326 | 10/1973 | Edgell et al. . | |
| 4,011,815 | 3/1977 | Garcia | 166/55.1 X |
| 4,140,188 | 2/1979 | Vann | 175/4.51 |
| 4,312,273 | 1/1982 | Lamp | 175/4.6 X |
| 4,319,526 | 3/1982 | DerMott | 102/310 |
| 4,326,462 | 4/1982 | Garcia et al. | 102/310 |
| 4,371,044 | 2/1983 | Willig et al. | 175/4.6 |
| 4,428,440 | 1/1984 | McPhee | 175/4.6 |
| 4,479,556 | 10/1984 | Stout et al. | 175/4.6 |
| 4,519,313 | 5/1985 | Leidel | 102/310 |
| 4,523,649 | 6/1985 | Stout | 175/4.51 |
| 4,523,650 | 6/1985 | Sehnert et al. | 175/4.56 |
| 4,534,423 | 8/1985 | Regalbuto | 175/4.6 |
| 4,541,486 | 9/1985 | Wetzel et al. | 166/297 |
| 4,543,703 | 10/1985 | Wetzel et al. | 29/455 |
| 4,583,602 | 4/1986 | Ayers | 175/4.52 |

*Primary Examiner*—George A. Suchfield

*Attorney, Agent, or Firm*—Richards, Harris, Medlock & Andrews

[57] ABSTRACT

An improved clip for holding an explosive shaped charge in a carrier strip is provided. The improved clip holds the shaped charge by inserting fingers into an annular groove formed around the perimeter near one end of the shaped charge. The clip and charge are in turn inserted into a carrier strip and held in place by notches cut into the clip. The carrier and its shaped charges are then inserted into a perforating gun tube. The carrier strip is held in position within the tube by use of spring-loaded lock pins. The lock pins are mounted on the strip so that a spring will force the pins inwardly away from the inner wall. A separate threaded screw with a cam surface is engaged to hold the lock pins in their outward position thus firmly securing the carrier strip in place.

16 Claims, 2 Drawing Sheets

FIG. 1
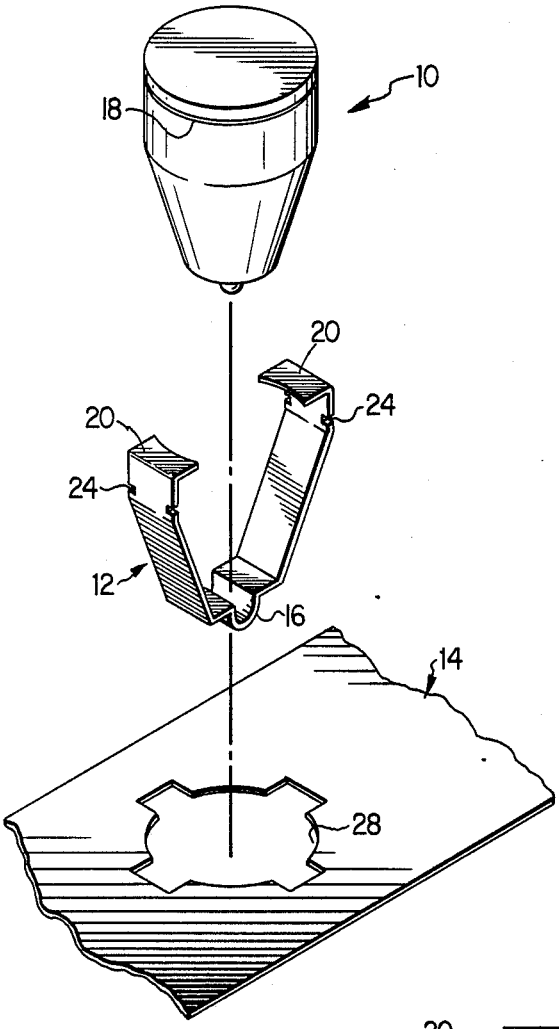
FIG. 2
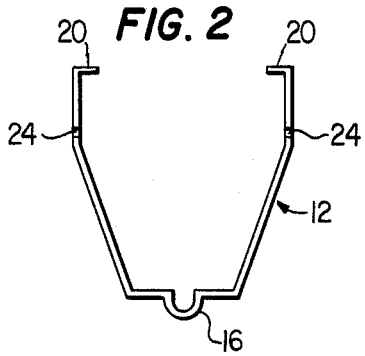
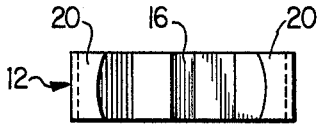
FIG. 3
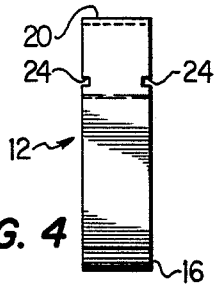
FIG. 4
FIG. 5
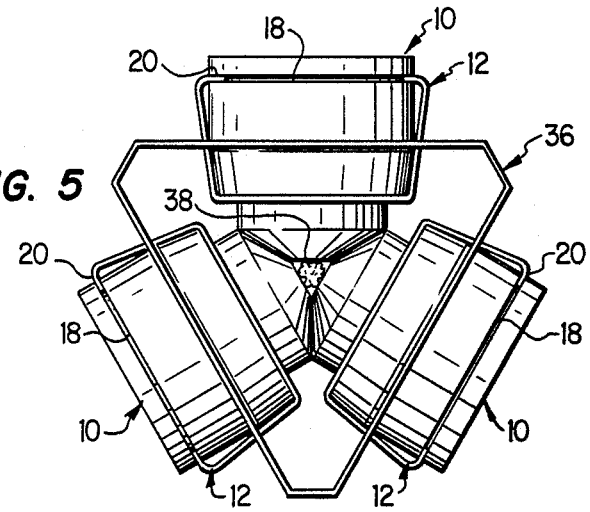

WELL PERFORATING GUN ASSEMBLY

BACKGROUND OF THE INVENTION

In order to successfully perforate a well at a desired depth it is necessary to accurately place a shaped charge within an expendable perforating gun tube. Typically an elongated perforating gun barrel is used. Shaped charges are secured into a carrier strip which is in turn secured into the gun barrel. Many different designs of clips have been used. Many different ways of securing the carrier within the gun barrel have also been used. It is the purpose of this invention to solve some of the difficulties encountered in the previous designs.

A retention clip is formed with two facing portions or fingers. These fingers are inserted into an annular groove formed near the perimeter of one end of a shaped charge. The charge and the clip are then inserted into an aperture in a carrier strip. Notches spaced apart from the fingers are cut into the clip so as to fit into and be securely held by the carrier. A "U" shaped portion is formed on the clip to allow a portion of primer cord to pass through and be held by the clip. This improved clip allows the charge to be placed using only one hand. It also forces the charge to stay in place if the carrier is somehow warped.

The carrier is normally placed inside a perforating gun tube. It is desirable to attach the carrier securely within the gun tube. Typically, this has been done by use of a threaded bolt passing through the carrier strip and abuting a portion of the gun tube. This method requires the use of a special angled tool for insertion into the tube to turn the threaded bolt out or in. The current invention solves this problem by providing a cam surface to force a spring-loaded pin outwardly into contact with the tube. The cam surface is part of a set screw which moves along the long axis of the carrier. By turning the set screw the cam surface engages the spring-loaded pin forcing it outwardly. By reversing the set screw the pin is disengaged and the spring-loading forces the pin away from the tube allowing removal of the carrier strip.

SUMMARY OF THE INVENTION

An improved retention clip for holding an explosive-shaped charge in a carrier strip and spring-loaded lock pins for holding the carrier strip in a perforating gun tube are provided. A shaped charge has an annular groove formed about its perimeter near one end. The improved retention clip is formed with two facing portions for insertion into the annular groove. The shaped charge is thus securely held by the clip. Spaced from the two facing portions are cut-in notches. These notches are used to receive a portion of the carrier to fix the clip relative to the carrier. A "U" shaped portion is formed on the clip to permit a primer cord to pass through the clip adjacent the attached charge for igniting the charge.

Spring-loaded lock pins are mounted on a carrier strip so that the pins will move outwardly to engage a slot inside a perforating gun tube. A separate threaded set screw is threaded into a portion of the strip for movement along the length of the strip. The set screw has a cam surface which bears against the end of a lock pin. By moving the set screw along the long axis of the strip, the pin can be moved by the cam surface into and out of engagement with a slot in the steel tube. By moving the pin outwardly the carrier strip is locked into position within the steel tube.

BRIEF DESCRIPTION OF THE DRAWINGS

For a more complete understanding of the present invention and for further advantages thereof, reference is now made to the following Description of preferred embodiment taken in conjunction with the accompanying Drawings, in which:

FIG. 1 is an exploded view of the present invention;

FIG. 2 is a side view of the clip;

FIG. 3 is a top view of the clip;

FIG. 4 is an end view of the clip;

FIG. 5 is a top view of an additional embodiment of the present invention;

DESCRIPTION OF THE PREFERRED EMBODIMENTS

Figure 7:
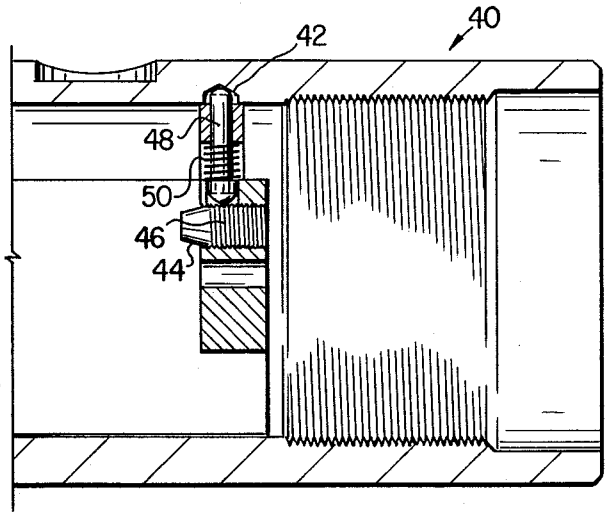
FIG. 7 is a cross sectional view of the spring loaded pin in the clockwise threaded embodiment.

Referring to FIG. 1 the present invention can be seen in conjunction with its various components. A shaped charge is indicated generally by 10. A clip 12 constructed of resilient material such as spring steel, plastic, or spring copper holds the shaped charge 10 by inserting facing portions 20 into the annular groove 18. The clip 12 and shaped charge 10 are then placed into an aperture 28 in a carrier strip 14. The clip 12 is held in place by the carrier strip 14 due to the notches 24 in clip 12. "U" shaped portion 16 is formed from clip 12 to hold a primer cord (not shown).

FIGS. 2, 3, and 4 depict one embodiment of the clip 12. As can be seen by these three drawings clip 12 is formed as a single piece with facing portions 20. Spaced apart from facing portions 20 are notches 24. As can be seen in FIG. 4 notches 24 are formed on opposite sides of the clip 12.

Figure 6:
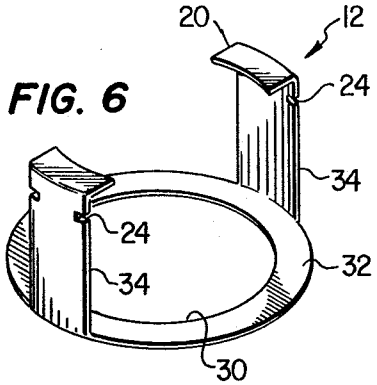
FIG. 6 is a perspective view of the embodiment of FIG. 5.

FIG. 5 shows use of another embodiment of clip 12 as used in multiple charge perforating. Per FIG. 6 clip 12 is formed from a single piece having a bottom section 32 and two members 34 extending subtantially perpendicular to bottom section 32. Facing portions 20 are formed at the tops of members 34. Shaped charges 10 are inserted into clips 12 with a portion of shape charge 10 passing through the hole 30. Facing portions 20 are inserted into annular groove 18 thus securely holding shaped charge 10. Shaped charge 10 and clip 12 are then inserted into aperture 28 of carrier 36. Carrier 36 has a substantially triangular cross sectional shape. Apertures 28 are placed so as to cluster shaped charges 10. A primer cord (not shown) can be passed through the space 38 formed by the ends of shaped charges 10.

Figure 8:
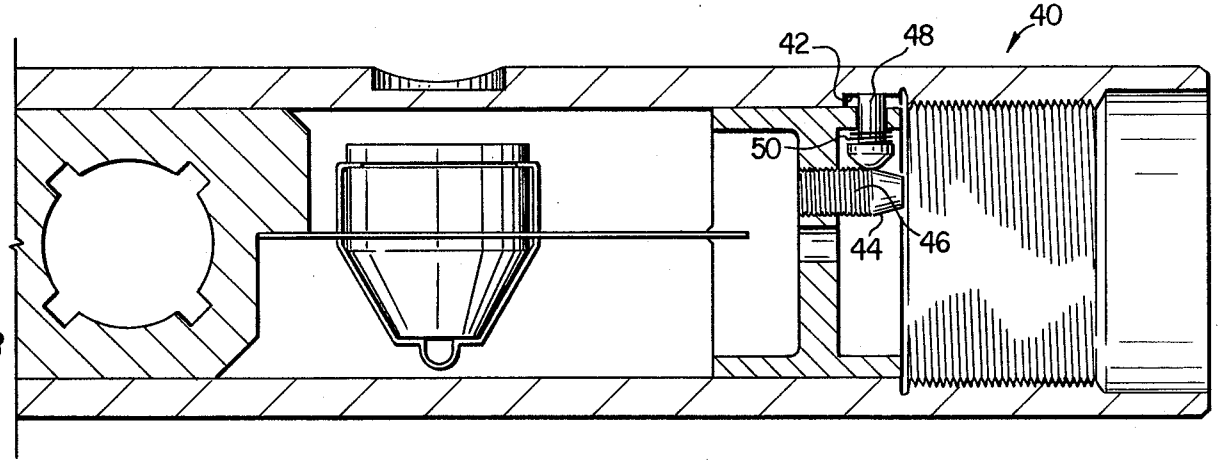
FIG. 8 is a cross sectional view of the spring loaded lock pin in a counterclockwise threaded embodiment.

Carrier strip 14 and carrier 36 are secured in a cylindrical perforating gun 40 as seen in FIGS. 7 and 8. FIG. 7 depicts one embodiment in which separate threaded set screw 46 is turned clockwise to force spring loaded lock pin 48 into slot 42. FIG. 8 depicts another embodiment in which separate threaded set screw 46 is turned counter-clockwise to force spring loaded lock pin 48 into slot 42. Cam surface 44 of separate threaded set screw 46 allows spring loaded lock pin 48 to move in or out depending upon which direction separate threaded set screw 46 is turned. Spring 50 forces spring loaded lock pin 48 away from slot 42 when it is not held by the cam surface 44 on separate threaded set screw 46. Separate threaded set screw 46 is easily reached externally to the perforating gun tube 40 by using any appropriate standard tool (not shown).

Although the present invention has been described with respect to a specific preferred embodiment thereof, various changes and modifications may be suggested to one skilled in the art, and it is intended that the present invention encompass such changes and modifications as fall within the scope of the appended claims.

I claim:

1. An improved well perforating gun assembly comprising:

a cylindrical perforating gun having an internal side with slot;

a carrier strip, having a length and a plurality of apertures, for insertion in said cylindrical perforating gun;

at least one shaped charge having an annular groove formed near one end;

a clip for holding said shaped charge by said annular groove;

said clip being insertable into and held securely by said carrier strip;

said carrier strip having means by which it is securely held in said cylindrical perforating gun;

said means consisting of spring loaded lock pins that fits into said slot, in said cylindrical perforating gun; and whereby a shaped charge is securely held by a clip in the carrier strip which is in turn securely held in the cylindrical perforating gun.

2. An improved well perforating gun assembly comprising:

a cylindrical perforating gun having an internal side with a slot;

a carrier strip, having a length and a plurality of apertures, for insertion in said cylindrical perforating gun;

at least one shaped charge having an annular groove formed near one end;

a clip for holding said shaped charge;

said clip being formed as a single piece with facing portions;

said facing portions being insertable into said annular groove in said shaped charge;

said clip being insertable into and held securely by said carrier strip;

said carrier strip having means by which it is securely held in said cylindrical perforating gun;

said means consisting of a spring loaded lock pin that fits into said slot, in said cylindrical perforating gun; and whereby a shaped charge is securely held by a clip in the carrier strip which is in turn securely held in the cylindrical perforating gun.

3. An improved well perforating gun assembly comprising:

a cylindrical perforating gun having an internal side with a slot;

a carrier strip, having a length and a plurality of apertures, for insertion in said cylindrical perforating gun;

at least one shaped charge having an annular groove formed near one end;

a clip for holding said shaped charge;

said clip being formed as a single piece with facing portions;

said facing portions being insertable into said annular groove in said shaped charge;

said clip having notches spaced apart from said facing portions for inserting into one of said apertures in said length of said carrier strip;

said carrier strip having a spring-loaded lock pin and a separate threaded set screw with a cam surface;

said separate threaded set screw being threaded into said carrier strip for movement along said length of said carrier strip;

said spring-loaded lock pin bearing on said cam surface of said separate threaded set screw;

said spring-loaded lock pin mounted so as to move to engage said slot in said cylindrical perforating gun upon contact with said cam surface of said separate threaded set screw; and whereby a shaped charge is securely held by a clip in the carrier strip which is in turn securely held in the cylindrical perforating gun.

4. The improved well perforating gun assembly of claim 3, wherein the clip is formed from spring steel.

5. The improved well perforating gun assembly of claim 3, wherein the clip is formed from plastic.

6. The improved well perforating gun assembly of claim 3, wherein the clip is formed from spring copper.

7. The improved well perforating gun assembly of claim 3, wherein the clip has a "U" shaped member for placement of a primer cord.

8. The improved well perforating gun assembly of claim 3, wherein the separate threaded set screw turns clockwise to engage the spring-loaded lock pin.

9. The improved well perforating gun assembly of claim 3, wherein the separate threaded set screw turns counterclockwise to engage the spring-loaded lock pin.

10. An improved well perforating gun assembly comprising:

a cylindrical perforating gun having an internal side with a slot;

a carrier strip, having a length and a plurality of apertures, for insertion in said cylindrical perforating gun;

at least one shaped charge having an annular groove formed near one end;

a clip for holding said shaped charge;

said clip being formed as a single piece having a bottom section and two members extending substantially perpendicular to said bottom section with facing portions at their top;

said bottom section having a hole for receiving said shaped charge;

said facing portions being insertable into said annular groove in said shaped charge;

said clip having notches spaced apart from said facing portions for insertion into one of said apertures in said length of said carrier strip;

said carrier strip having a spring-loaded lock pin and a separate threaded set screw with a cam surface;

said separate threaded set screw being threaded into said carrier strip for movement along said length of said carrier strip;

said spring-loaded lock pin bearing on said cam surface of said separate threaded set screw;

said spring-loaded lock pin mounted so as to move to engage said slot in said cylindrical perforating gun upon contact with said cam surface of said separate threaded set screw; and whereby a shaped charge is securely held by a clip in the carrier strip which is in turn securely held in the cylindrical perforating gun.

11. The improved well perforating gun assembly of claim 10, wherein the clip is formed from spring steel.

12. The improved well perforating gun assembly of claim 10, wherein the clip is formed from plastic.

13. The improved well perforating gun assembly of claim 10, wherein the clip is formed from spring copper.

14. The improved well perforating gun assembly of claim 10, wherein the separate threaded set screw turns clockwise to engage the spring loaded lock pin.

15. The improved well perforating gun assembly of claim 10, wherein the separate threaded set screw turns counterclockwise to engage the spring loaded lock pin.

16. An improved well perforating gun assembly comprising:

a cylindrical perforating gun;

a carrier strip for mounting within the cylindrical perforating gun, said carrier strip having a length and a plurality of apertures, each aperture having a generally circular shape with cut outs on opposite sides of the circular shape of a predetermined width;

at least one shaped charge having an annular groove formed near one end;

a U-shaped clip for holding said shaped charge by said annular groove, said clip being formed of a resilient material and having a bottom section, a pair of arms extending from the bottom section and facing portions formed at the free ends of said arms, each facing portion having an arc of radius corresponding to the radius of the annular groove in the shape charge, the clip resiliently holding the shaped charge between the facing portion;

said clip being insertable into and held securely by said carrier strip, each of said arms of said clip having notches formed therein to permit each arm to fit into a cut out in said carrier strip, the notches fitting around the edges of the cut out to hold the clip in the carrier strip, the clip and held shaped charge being insertable into and removable from the carrier strip by resiliently deforming the arms of the clip out of the cut outs in the carrier strip.

* * * * *